US005613448A

United States Patent [19]

Petty

[11] Patent Number: 5,613,448

[45] Date of Patent: Mar. 25, 1997

[54] NESTING DESK

[75] Inventor: David W. Petty, Belton, Tex.

[73] Assignee: Royal Seating Corporation, Cameron, Tex.

[21] Appl. No.: 504,681

[22] Filed: Jul. 20, 1995

[51] Int. Cl.[6] ..... A47B 7/00

[52] U.S. Cl. ..... 108/91

[58] Field of Search ..... 108/91, 53.3, 92, 108/194, 53.1, 53.5; 297/239; 211/188

[56] References Cited

U.S. PATENT DOCUMENTS

| | | | |
|---|---|---|---|
| D. 153,909 | 5/1949 | Wais . | |
| 2,657,965 | 11/1953 | Bargen | 108/91 X |
| 2,709,119 | 5/1955 | Chapman et al. | 108/91 |
| 2,871,073 | 1/1959 | Swanson | 108/91 |
| 2,894,561 | 7/1959 | Mackintosh . | |
| 3,408,965 | 11/1968 | Hamilton et al. | 108/91 |
| 3,724,897 | 4/1973 | Faiks et al. | 297/239 X |
| 4,067,606 | 1/1978 | Desmoulins nee Fouchereau et al. . | |

FOREIGN PATENT DOCUMENTS

| | | | |
|---|---|---|---|
| 173825 | 7/1952 | Austria | 108/91 |
| 2208441 | 8/1973 | Germany | 108/91 |
| 3903351 | 8/1990 | Germany | 108/91 |
| 600217 | 11/1959 | Italy | 297/239 |
| 848254 | 9/1960 | United Kingdom | 108/91 |

*Primary Examiner*—Jose V. Chen
*Attorney, Agent, or Firm*—Arthur F. Zobal

[57] ABSTRACT

The desk has a top member and two pairs of legs with each pair of legs including a front leg and a rear leg with the front leg effectively having a height greater than that of the rear leg such that the front edge of the top member is higher than the rear edge of the top member. The front edge of the top member has a length greater than the length of the rear edge of the top member such that the top member is generally trapezoidal in shape. The two pairs of legs are secured to the lower side of the top member near its two side edges respectively such that the front legs are located at the front of the desk and the rear legs are located at the rear of the desk and the distance between the two front legs is greater than the distance between the two rear legs. Two of the desks may be nested together by locating the rear legs and the rear portion of the top member of one desk between the front legs and under the front portion of the top member respectively of the other desk.

10 Claims, 6 Drawing Sheets

NESTING DESK

BACKGROUND OF THE INVENTION

1. Field of the Invention

The invention relates to desks that may be nested together by sliding one desk partially under another desk.

2. Description of the Prior Art

U.S. Pat. Nos. Des. 153,909; 2,657,965; 2,709,119; 2,871,073; 2,894,561; and 4,067,606 disclose different types of nestable tables and chairs.

SUMMARY OF THE INVENTION

It is an object of the invention to provide a new and useful desk that can be readily nested with another similar desk.

The desk comprises two pairs of legs and a top member having an upper side, a lower side, a front edge, a rear edge, and two side edges. Each pair of legs comprises a front leg and a rear leg with the front leg effectively having a height greater than that of the rear leg such that the front edge of the top member is higher than the rear edge of the top member. The front edge of the top member has a length greater than the length of the rear edge such that the top member is generally trapezoidal in shape. The two pairs of legs are secured to the lower side of the top member near the two side edges respectively such that the front legs are located at the front of the desk and the rear legs are located at the rear of the desk and the distance between the two front legs is greater than the distance between the two rear legs wherein two of the desks may be nested together by locating the rear legs and the rear portion of the top member of one desk between the front legs and under the front portion of the top member respectively of another desk.

In one aspect, each of the pairs of legs comprise a closed loop having an upper portion and a lower portion with the upper portion slanting downward from the top of the front leg to the top of the rear leg relative to the lower portion.

The rear legs extend forward between their lower and upper ends to provide more space for a person's knees when one gets up from the desk or sits down at the desk.

DESCRIPTION OF THE PREFERRED EMBODIMENT

Figure 1:
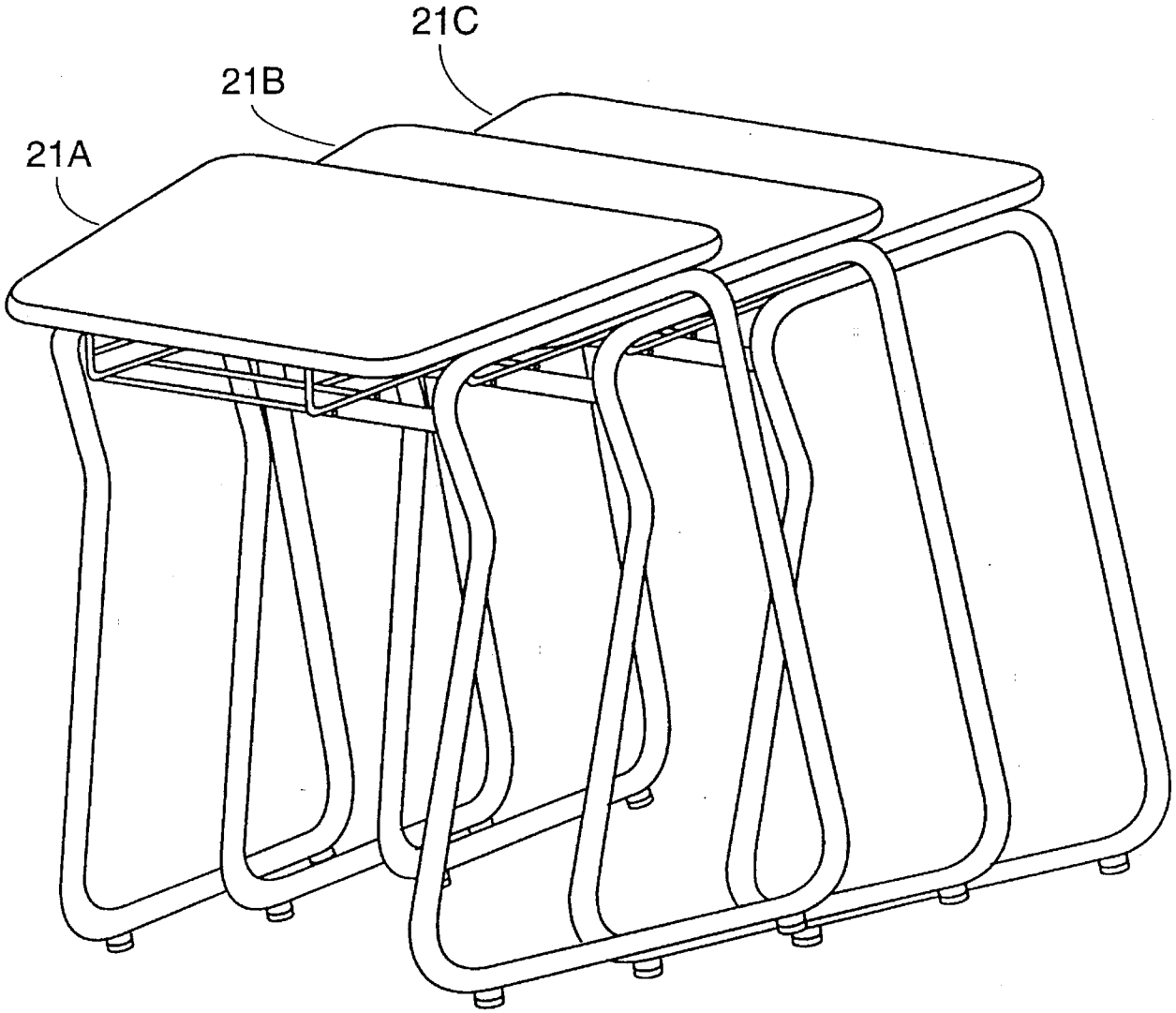
FIG. 1 is an isometric view of three of the desks of the invention nested together.
Figure 2:
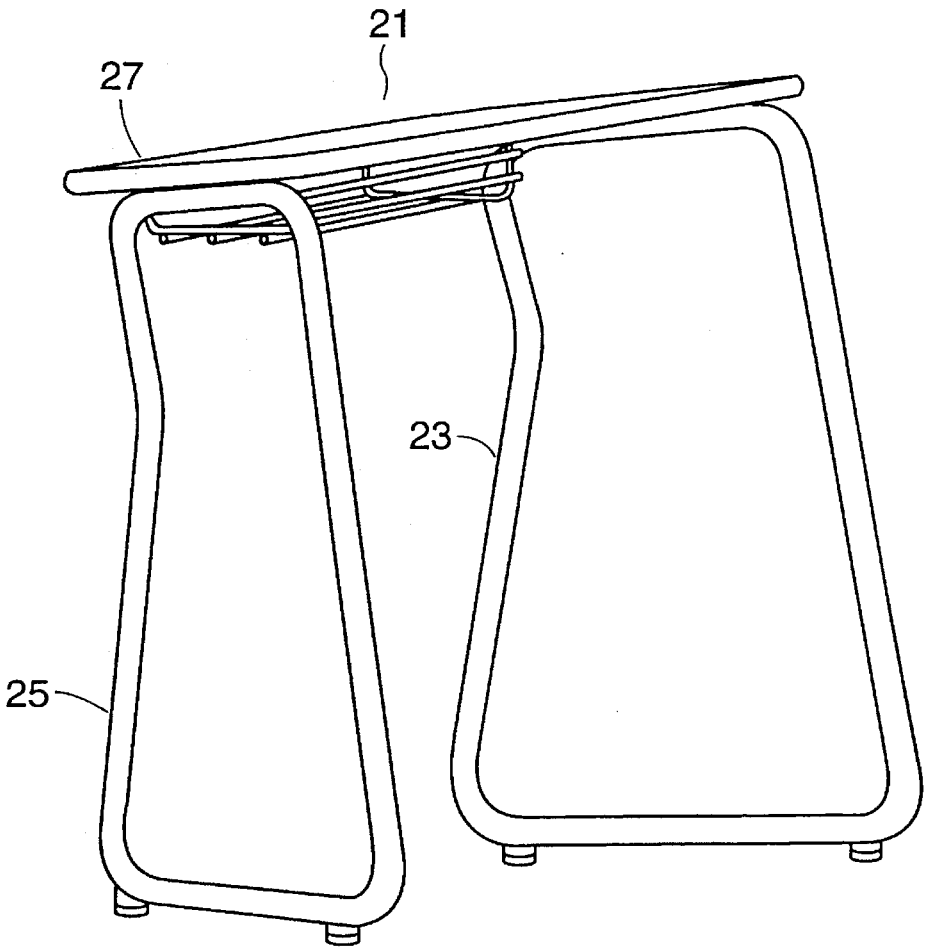
FIG. 2 is an isometric view of one of the desks of the invention as seen from the front and a side thereof.
Figure 3:
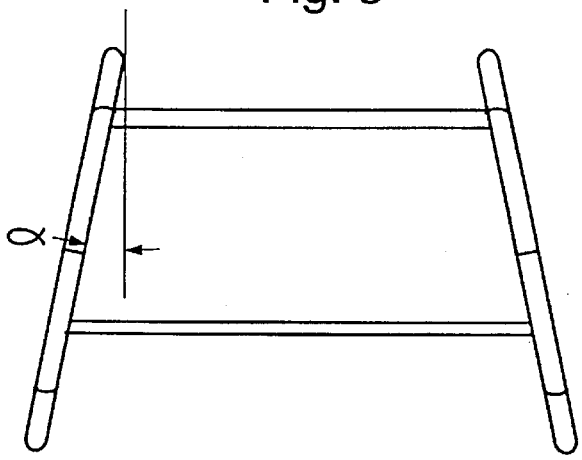
FIG. 3 is a top plan view of the legs of the desk.
Figure 4:
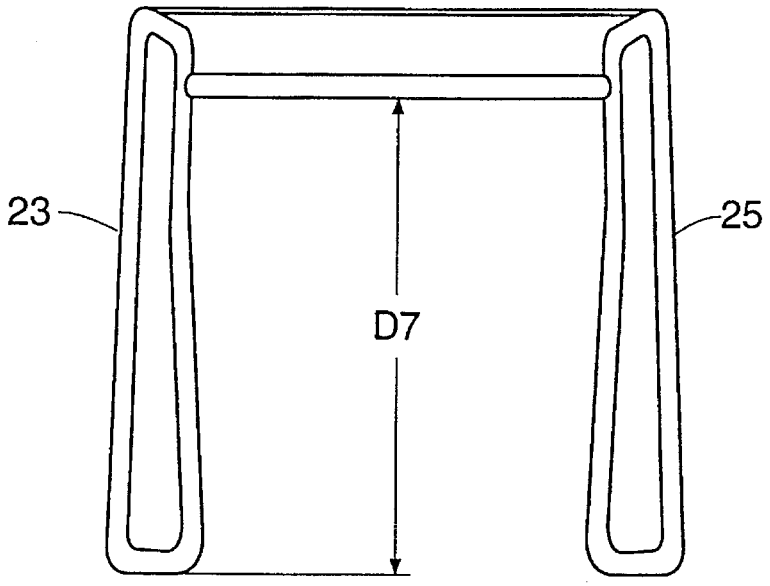
FIG. 4 is a rear view of the legs of the desk.
Figure 5:
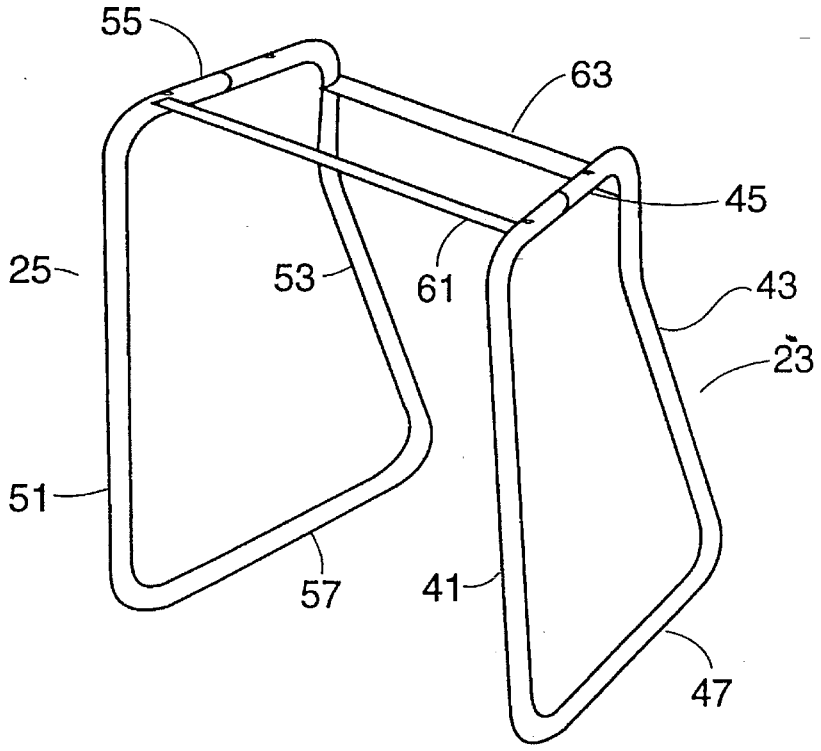
FIG. 5 is an isometric view of the legs of the desk.
Figure 6:
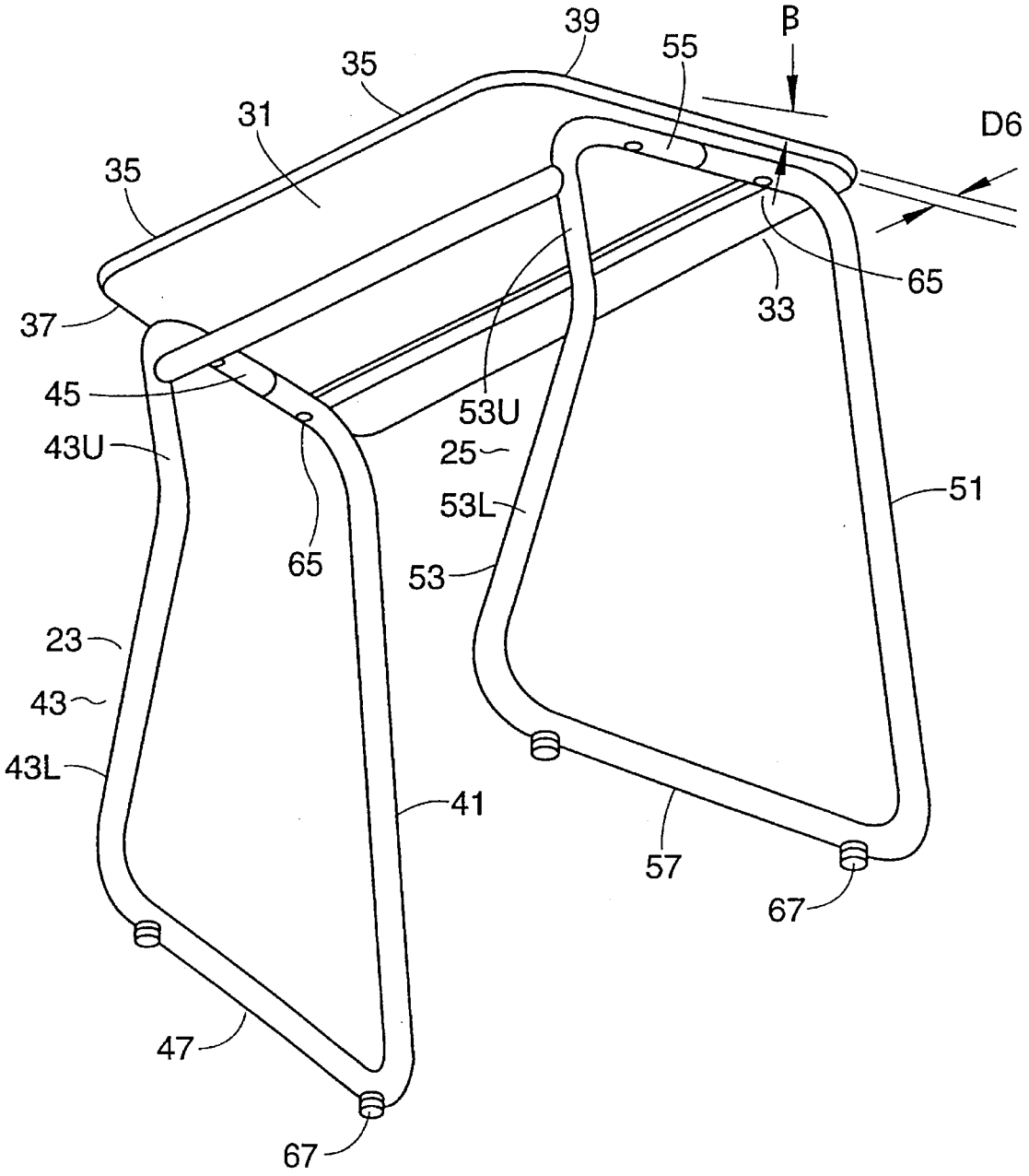
FIG. 6 is an isometric view of the desk as seen from the bottom side.
Figure 7:
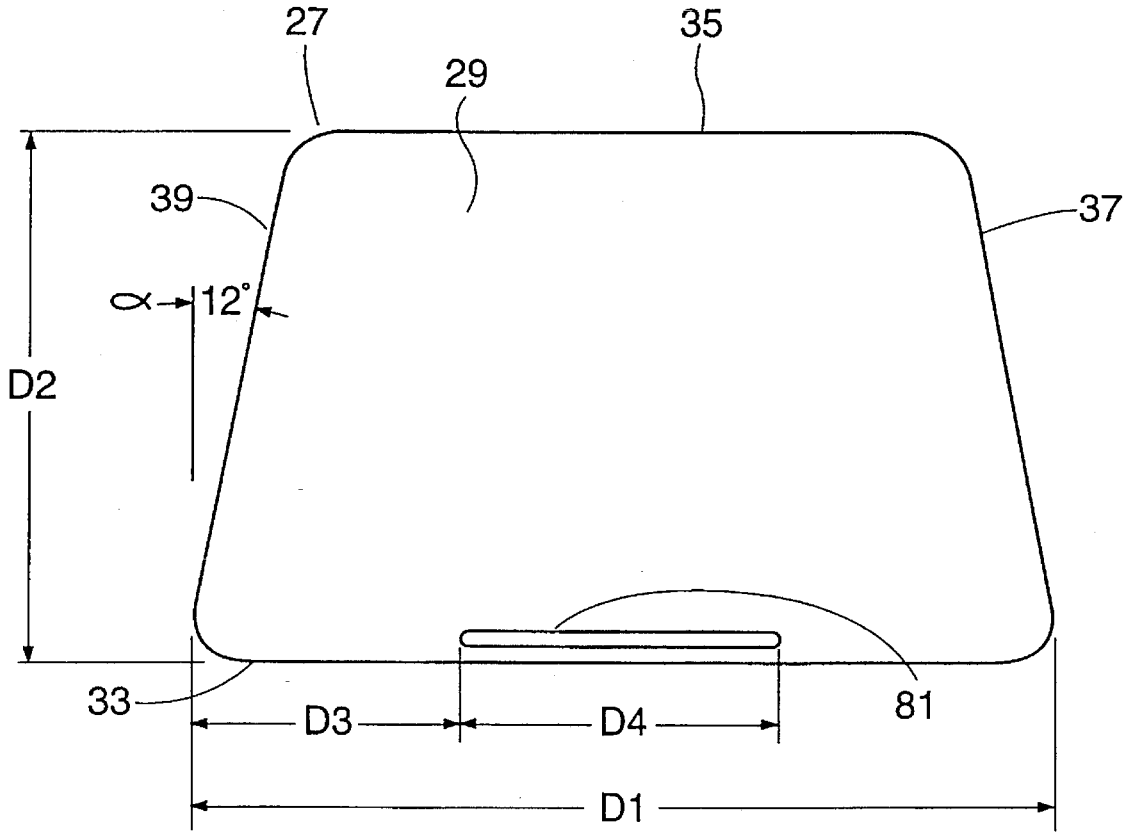
FIG. 7 is a top plan view of the top member of the desk.
Figure 8:
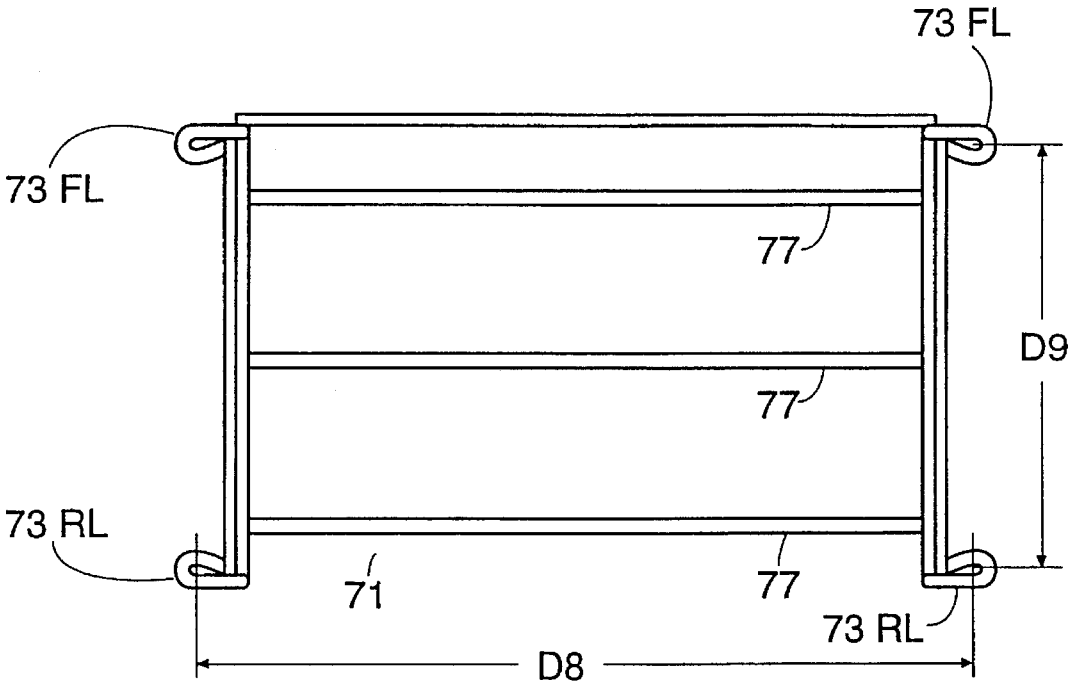
FIG. 8 is a top plan view of a basket of the desk.
Figure 9:
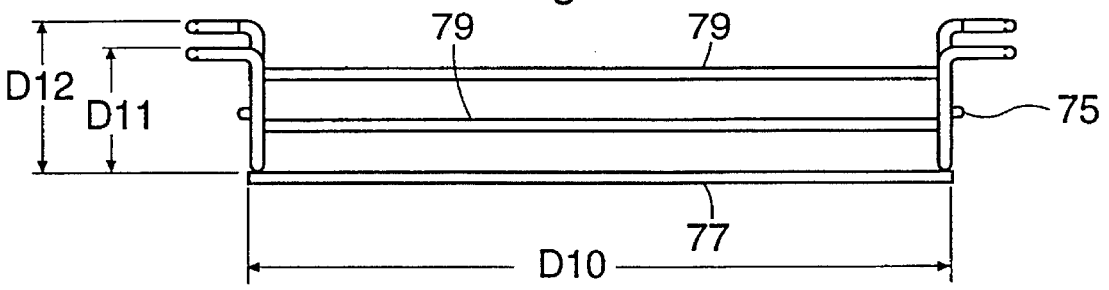
FIG. 9 is a rear plan view of the basket of the desk.
Figure 10:
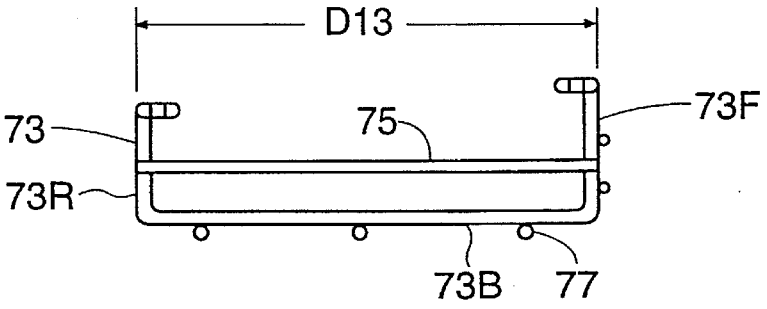
FIG. 10 is a side plan view of the basket of the desk.

Referring now to the drawings, the desk of the invention is identified by reference numeral 21. Three of the desks are shown at 21A, 21B, and 21C in FIG. 1, nested together. The desks 21A, 21B, and 21C are identical. The desk 21 comprises two pairs of legs 23 an 25 and a top member or desk top 27. The top member 27 is trapezoidal in shape having an upper side 29, a lower side 31, a front edge 33, a rear edge 35, and two side edges 37 and 39. The length of the front edge 33 is greater than that of the rear edge 35. The edges 37 and 39 are equal in length.

Leg 23 is a closed loop metal tube comprising a front leg 41, a rear leg 43, an upper portion 45 and a lower portion 47. Leg 25 is a closed loop metal tube comprising a front leg 51, a rear leg 53, an upper portion 55 and a lower portion 57. Legs 23 and 25 are identical.

The upper portions 45 and 51 are connected together at the front by a flat metal brace 61 and the upper portions of the rear legs 43 and 53 are connected together by a round metal brace 63.

The upper edges of the upper portions 45 and 55 of the legs 23 and 25 are connected to the lower side 31 of the top member 27 near the side edge 37 and 39 respectively by screws 65. The effective heights of the from legs 41 and 51 are greater than that of the rear legs 43 and 53 respectively relative to the bottom portions 47 and 57 such that the front edge 33 of the top member 27 is higher than the rear edge 35 of the top member 27. The top and bottom sides 29 and 31 of the top member 27 slopes downward from the front edge 33 to the rear edge 35 by about 5 degrees. Glide members 67 are secured to the bottom edges of the bottom portions 47 and 57 of the legs 23 and 25 for engaging the floor.

Secured to the rear of the desk 21 below the desk top 21 is a metal wire basket 71 for use for storing books, papers, magazines, etc. The basket 71 comprises two U-shaped side members 73. Each member 73 has a bottom portion 73B, a rear portion 73R, and a front portion 73F. The front portion 73F has a greater dimension than the rear portion 73R and the free ends of the front and rear portions 73F and 73R have closed loops 73FL and 73RL for attachment by screws to the rear of the bottom side 31 of the desk top above the rear bar 63 such that the bottom portions 73B of the side members 73 will be level with the floor when the desk is supported by the floor. Each side member 73 has a metal side rod 75 secured to the front and rear portions 71F and 71R. Secured to the bottom portions 73B of the members 71 are three spaced apart metal bottom rods 77. Also secured to the front portions 73F of the two side members are two spaced apart metal front rods 79. The space between the two rear portions 73R of the side members 71 is open for receiving books, papers, etc. to be supported by the bottom rods 77. The front rods 79 limit the forward position of the books, papers, etc.

The distance between the front legs 41 and 51 is greater than the distance between the rear legs 43 and 53 and the height of the front edge 33 is greater than the height of the rear edge 35 of the desk top 27 whereby two of the desks 21 may be nested together by locating the rear of the desk top 21 and the rear legs 43 and 53 of one desk 21B below the front of the desk top 21 of the other desk 21A with the rear legs 43 and 53 of the desk 21B located between the front legs 41 and 51 of the other desk 21A as shown in FIG. 1 until the rear edge 35 of the desk 21B engages the front of the basket 71 of desk 21A as shown in FIG. 1 Nesting allows the desks to be stored in a minimum of space by sliding on the floor the rear of one desk under the front of the other desk without the necessity of any lifting of the desks. When it is desired to use the nested desks, the nested desks can be separated by sliding on the floor the two desks away from each other.

The rear leg 43 has two straight portions 43L and 43U which define an obtuse angle $\sigma$ at the bend. Similarly, the rear leg 53 has two straight portions 53L and 53U which define an obtuse angle σ at the bend. The lower portions 43L and 53L have lengths greater than the lengths of the upper portions 43U and 53U. The spaces between the leg portions 43L, 43U and 53L, 53U provide more space for a persons legs when one gets up from the desk or sits down at the desk.

In one embodiment, the desk top 27 may be formed of a flat panel wood having a thickness of about ⅝ to ¾ of an inch. The panel is formed of wood with plastic laminated on the upper and lower sides. A groove 81 is formed in the top of the desk top 21 near the front edge 33 for holding pencils, etc. Dimensions D1, D2, D3, and D4 may be equal to 30 inches, 18 inches, 9½ inches and 11 inches respectively. Angles α and β, are equal to 12° and 5°, respectively. The front of the desk from the floor to the top of the desk top is 31 inches and the back of the desk from the floor to the top of the desk top is equal to 29⅞ inches. D6 and D7 are equal to about ¼ of an inch and 25½ inches respectively.

For the basket 71, D8, D9, D10, D11, D12, and D13 are equal to 14 7/16 inches, 7 13/16 inches, 13 inches, 2¼ inches, 2¾ inches, and 8½ inches respectively. It is to be understood that the desk may have other dimensions and specifications.

I claim:

1. A desk comprising:

two pairs of legs and a top member having an upper side, a lower side, a front edge, a rear edge, and a two side edges;

each pair of legs comprising a front leg and a rear leg with said front leg effectively having a height greater than that of said rear leg such that said front edge of said top member is higher than said rear edge of said top member;

said front edge of said top member having a length greater than the length of said rear edge of said top member such that said top member is generally trapezoidal in shape;

said two pairs of legs being secured to said lower side of said top member near said two side edges respectively such that said front legs are located at the front of said desk and said rear legs are located at the rear of said desk and the distance between said two front legs is greater than the distance between said two rear legs.

2. The desk of claim 1, wherein:

the space between said two pairs of legs is generally trapezoidal as seen in a horizontal plane passing through said two pairs of legs at a given level near said top member and looking downward and is generally rectangular as seen in different parallel vertical planes passing through said two side edges of said top member with the distance between the sides of each rectangle decreasing as seen in each vertical plane progressing rearward.

3. The desk of claim 1, wherein:

each of said front and rear legs has upper and lower ends, each of said pairs of legs comprise a closed loop having an upper portion coupled to the upper ends of said front and rear legs of each pair and a lower portion coupled to the lower ends of said front and rear legs of each pair with said upper portion slanting downward from said upper end of said front leg to said upper end of said rear leg relative to said lower portion.

4. The desk of claim 3, wherein:

each of said rear legs has upper and lower ends and is shaped such that between its upper and lower ends, each of said rear legs extend forward to provide a space between each of said rear legs and a straight line extending between said upper and lower ends of each of said rear legs.

5. The desk of claim 1, wherein:

each of said rear legs has upper and lower ends and is shaped such that between its upper and lower ends, each of said rear legs extend forward to provide a space between each of said rear legs and a straight line extending between said upper and lower ends of each of said rear legs.

6. At least two desks adapted to be nested together wherein each desk comprising:

two pairs of legs and a top member having an upper side, a lower side, a front edge, a rear edge, and two side edges;

each pair of legs comprising a front leg and a rear leg with said front leg effectively having a height greater than that of said rear leg such that said front edge of said top member is higher than said rear edge of said top member;

said front edge of said top member having a length greater than the length of said rear edge of said top member such that said top member is generally trapezoidal in shape;

said two pairs of legs being secured to said lower side of said top member near said two side edges respectively such that said front legs are located at the front of said desk and said rear legs are located at the rear of said desk and the distance between said two front legs is greater than the distance between said two rear legs wherein of said two desks may be nested together by locating said rear legs and the rear portion of said top member of one desk between said front legs and under the front portion of said top member respectively of said other desk.

7. Each of the desk of claim 6, wherein:

the space between said two pairs of legs is generally trapezoidal as seen in a horizontal plane passing through said two pairs of legs at a given level near said top member and looking downward and is generally rectangular as seen in different parallel vertical planes passing through said two side edges of said top member with the distance between the sides of each rectangle decreasing as seen in each vertical plane progressing rearward.

8. Each of the desk of claim 6, wherein:

each of said front and rear legs has upper and lower ends, each of said pairs of legs comprise a closed loop having an upper portion coupled to the upper ends of said front and rear legs of each pair and a lower portion coupled to the lower ends of said front and rear legs of each pair with said upper portion slanting downward from said upper end of said front leg to said upper end of said rear leg relative to said lower portion.

9. Each of said desks of claim 8, wherein:

each of said rear legs has upper and lower ends and is shaped such that between its upper and lower ends, each of said rear legs extend forward to provide a space between each of said rear legs and a straight line extending between said upper and lower ends of each of said rear legs.

10. The desk of claim 6 wherein:

each of said rear legs has upper and lower ends and is shaped such that between its upper and lower ends, each of said rear legs extend forward to provide a space between each of said rear legs and a straight line extending between said upper and lower ends of each of said rear legs.

* * * * *